US012024904B2

(12) United States Patent
Haeberle

(10) Patent No.: US 12,024,904 B2
(45) Date of Patent: Jul. 2, 2024

(54) SUPPORT MEANS, CEILING SUPPORTS, CEILING FRAMEWORK SYSTEM AND METHOD FOR REMOVING A CEILING FRAMEWORK PANEL

(71) Applicant: Peri SE, Weissenhorn (DE)

(72) Inventor: Wilfried Haeberle, Langenau (DE)

(73) Assignee: PERI SE, Weissenhorn (DE)

( * ) Notice: Subject to any disclaimer, the term of this patent is extended or adjusted under 35 U.S.C. 154(b) by 110 days.

(21) Appl. No.: 17/694,576

(22) Filed: Mar. 14, 2022

(65) Prior Publication Data

US 2022/0290449 A1 Sep. 15, 2022

(30) Foreign Application Priority Data

Mar. 12, 2021 (DE) ..... 10 2021 106 138.5

(51) Int. Cl.
*E04G 11/48* (2006.01)
*E04G 25/06* (2006.01)

(52) U.S. Cl.
CPC ..... *E04G 11/483* (2013.01); *E04G 11/48* (2013.01); *E04G 25/061* (2013.01)

(58) Field of Classification Search
CPC ..... E04G 11/483; E04G 11/48; E04G 11/486; E04G 25/061; E04G 25/065; E04G 25/04; E04G 17/16; E04G 11/38; E04G 2025/003; E04G 2025/006; E04G 2025/045; E01D 19/125; E01D 2101/24; E04B 1/003; F16M 2200/021; F16M 2200/025
USPC ..... 248/351
See application file for complete search history.

(56) References Cited

U.S. PATENT DOCUMENTS 7,603,817 B2 * 10/2009 Lewis ..... E04F 21/185 52/DIG. 1
10,024,069 B2 * 7/2018 Bond ..... E04G 11/486
2020/0407991 A1 * 12/2020 Sturm ..... E01D 19/125
2023/0012935 A1 * 1/2023 Poon ..... E04G 11/483

FOREIGN PATENT DOCUMENTS

DE 7014580 8/1972
DE 254045 2/1988
DE 29705696 5/1997
DE 102018203612 9/2019
EP 2880228 B1 6/2015
(Continued)

*Primary Examiner* — Nkeisha Smith
(74) *Attorney, Agent, or Firm* — SLEMAN & LUND LLP

(57) ABSTRACT

A support means for a ceiling support for supporting a ceiling formwork panel. The support means has at least one upper elongated support element and a lower elongated support element. The support elements are rotationally connected to one another, with the support elements being able to be brought into a working position in which the support elements are preferably aligned coaxially with one another. The support elements can be rotated into a tilted position in which the support elements are rotated relative to one another by a tilting angle. A locking element is provided, which secures the support elements against rotating in the working position, the locking element bridging a connecting region between the two support elements in the working position. The locking element can be brought into a release position in which the locking element is arranged outside the connecting region.

25 Claims, 10 Drawing Sheets

(56) References Cited

FOREIGN PATENT DOCUMENTS

| | | | |
|---|---|---|---|
| EP | 3401463 | A1 | 11/2018 |
| EP | 3712352 | | 9/2020 |
| JP | 3024923 | | 6/1996 |
| JP | H09268754 | | 10/1997 |
| WO | 2008061501 | | 5/2008 |
| WO | 2018233993 | | 12/2018 |

* cited by examiner

SUPPORT MEANS, CEILING SUPPORTS, CEILING FRAMEWORK SYSTEM AND METHOD FOR REMOVING A CEILING FRAMEWORK PANEL

FIELD OF THE INVENTION

The invention relates to a support means for a ceiling support for supporting a ceiling formwork panel.

The invention also relates to a ceiling support and a ceiling formwork system.

The invention also relates to a method for removing a ceiling formwork panel which is supported by at least one ceiling support.

BACKGROUND OF THE INVENTION

Ceiling formwork systems for producing ceilings, in particular for concreting concrete ceilings, are known in various designs from the prior art.

Known ceiling formwork systems can, for example, have a system of steel or wooden beams on which formwork panels are placed that form the underside of the concrete ceiling.

The formwork panels can also be attached to a rigid substructure which is usually made of steel or aluminum beams. Such a substructure with a formwork panel attached thereto is generally referred to as a panel or as a ceiling formwork panel.

The ceiling formwork panels can also be made of a polymer.

In the case of building ceilings, the ceiling formwork panel is usually supported by means of support elements, in particular ceiling supports. Such ceiling supports are often telescopic so that the ceiling support can be adjusted to different heights. Extensions, which can be mounted on an upper end of the ceiling support, generally on an adapter slat located there, are known from prior art as well.

So-called support heads are formed or mounted at the upper end of the ceiling support or at the upper end of the extension of the ceiling support. The support heads can be formed in one piece with the ceiling support or an extension of the ceiling support, but it is usually provided that the support heads are mounted detachably. The support heads extend the ceiling supports axially in the direction of the concrete ceiling to be created.

The support heads are designed in such a way that they engage with the ceiling formwork panels, preferably in such a way that they are able to hook into suitable structures that are present there, as a result of which such ceiling formwork systems can be set up quickly.

After the concrete has been poured, the ceiling formwork system formed by the ceiling formwork panels and the ceiling supports is under load. When removing the formwork from the at least partially hardened building ceiling, i.e., when removing the ceiling formwork panels after the concrete of the building ceiling has set, this load means that the ceiling formwork panels can be difficult to loosen. In order to facilitate the removal process, it is known from the prior art to provide lowering devices that make it possible to lower the ceiling formwork panels a few centimeters from the underside of the building ceiling so that the contact pressure on the ceiling supports is eliminated.

A spindle device, which the ceiling supports typically have, can be used to lower the ceiling supports and thus to lower the support head.

Other lowering devices that can be used additionally or alternatively are known from the prior art as well, for example DE 10 2018 203 612 A1.

Furthermore, WO 2018/233993 A1 discloses a method for removing a ceiling formwork panel. Particular reference is made in this regard to the description of FIG. 1*a* to FIG. 1*f*. WO 2018/233993 A1 also discloses a support head for a ceiling support that has a lowerable support height.

In general, concrete ceilings are made in such a way that their surface is horizontal.

In order to pour concrete on sloping concrete ceilings, it is known from the prior art to use support heads that can be rotated according to the desired inclination of the concrete ceiling and that can be fixed in the rotated position. In this regard, reference is made to WO 2008/061501 A1 and DD 254 045 A1.

It is known from the prior art pertaining to the construction of ceiling formwork systems, in particular using ceiling formwork panels, to insert these from above. Although it is relatively easy to insert ceiling formwork panels from above, it is not optimal in terms of safety.

It is therefore also known from the prior art to mount ceiling formwork panels, in particular large-panel ceiling formwork, from below, that is to say, from a lower level. The ceiling formwork panels can then safely be rotated upwards from a lower level. After having been rotated upwards, the ceiling formwork panel is then supported by a ceiling support with a suitable support head. In order to rotate the ceiling formwork panel upwards, it is usually provided that a side edge of the ceiling formwork panel to be rotated upwards is hooked onto a ceiling support that has already been put in position. The ceiling formwork panel can then be rotated upwards by using a formwork aid, which is generally a telescopic rod.

Irrespective of whether the positioning was carried out from above or below, the formwork for the ceiling formwork panels is removed in the downward direction since it is not possible to remove them in the upward direction due to the concrete ceiling. In order for the formwork to be removed from the ceiling formwork panels, the ceiling supports must first be lowered at least along one side edge of the ceiling formwork panels to such an extent that they no longer engage in the ceiling formwork panels.

A problem when removing ceiling formwork panels is that when the ceiling formwork panels are rotated away or downward, the support heads of the ceiling supports which were previously lowered are in the rotation path. This makes it difficult to remove the ceiling formwork panels in a simple and safe manner.

The support heads are usually lowered by the spindle mechanism of the ceiling supports. However, the spindle travel is limited and generally not sufficient to completely remove the support head from the rotation path of the ceiling formwork panels. In addition, this type of lowering in which the support head is no longer in the rotation path of the ceiling formwork panels is strenuous and time consuming.

Alternatively, it is possible to completely remove the ceiling support before the ceiling formwork panel is rotated. However, this solution also has disadvantages, in particular if the ceiling supports are scaffolding poles that are set up in a scaffolding system. It may not be possible to remove the ceiling supports (scaffolding poles).

SUMMARY OF THE INVENTION

The present invention is therefore based on the object of creating a support means for a ceiling support for supporting a ceiling formwork panel which allows for a simple and safe removal or a simple and safe dismantlement of the ceiling formwork panel.

The present invention is also based on the object of creating a ceiling support that allows for a simple and safe removal or a simple and quick dismantlement of a ceiling formwork panel.

The invention is also based on the object of creating a ceiling formwork system which allows for a simple and safe removal or simple and safe dismantlement of a ceiling formwork panel.

Furthermore, the present invention is based on the object of providing a method for removing a ceiling formwork panel with which the ceiling formwork panel can be easily and safely removed or dismantled.

The support means according to the invention for a ceiling support for supporting a ceiling formwork panel has at least one upper elongated support element and one lower elongated support element. The support elements are rotatably connected to one another, the support elements being able to be brought into a working position in which the support elements are preferably aligned coaxially with one another, and the support elements being rotatable into a tilted position in which the support elements are rotatable by a tilting angle with respect to one another. A locking element is provided, which secures the support elements against rotation in the working position, with the locking element bridging a connecting region between the two support elements in the working position. The locking element can be brought into a release position in which the locking element is arranged outside of the connecting region.

Insofar as the terms "upper" and "lower" are used within the scope of the invention, this refers to a design-specific or correct use of a ceiling support or the support means for a ceiling support according to the invention.

The ceiling support can in particular be a scaffolding pole or a vertical pole. The ceiling support can also have a scaffolding pole or a vertical pole as a component.

The inventor has recognized that an advantageous, in particular simple and safe, removal of a ceiling formwork panel is possible if a support means for a ceiling support is designed in such a way that it has at least one upper elongated support element and one lower elongated support element which are both rotatably connected to one another. This makes it possible to align the support means in a working position in such a way that it can absorb the weight forces that arise when making a concrete ceiling, in particular when pouring concrete into a concrete ceiling, in the usual manner. For this purpose, the support elements in the working position are preferably aligned parallel, in particular coaxially, to one another so that the forces that occur can be advantageously transferred.

In the working position, the support elements are generally aligned in such a way that they run coaxially to the longitudinal axis of the ceiling support.

If the ceiling to be created runs in a horizontal plane, it is usually provided that the support elements are aligned orthogonally to the underside of the ceiling to be created and are therefore also aligned orthogonally to the underside of the ceiling formwork panels. If a sloping ceiling is to be produced, it can preferably be provided that the support elements are not aligned orthogonally to the ceiling to be created or the underside of the ceiling formwork panels but run at an angle to the orthogonal plane. However, the support elements are preferably aligned coaxially with the ceiling support, which is preferably placed orthogonally on a plane which is located below the ceiling to be created.

According to the invention, it is provided that the support elements are connected to one another in such a way that the support elements can be rotated into a tilted position. Preferably, the upper elongated support element is rotated out. This makes it possible to rotate a support head, which is connected to the upper elongated support element in such a way that the support head is no longer in the rotation path of the ceiling formwork panels when they are rotated downwards for the purpose of removing the formwork.

According to the invention, it is provided that the elongated support elements are secured against rotation in the working position.

Reliable protection against an unintentional rotation of the support elements when they are in the working position is important for operational safety reasons.

In the working position, it must be ensured that the forces to be absorbed can be absorbed in a reliable manner. For this purpose, a locking element is provided according to the invention which secures the support elements against rotation.

It is provided that the locking element bridges a connecting region between the two support elements in the working position. This reliably prevents the support elements from rotating unintentionally into the tilted position. Furthermore, the stability of the two support elements in the working position is supported by bridging the connecting region.

The movement of the support elements into a tilted position, in particular by tilting the upper support element by a tilting angle relative to the lower support element, can be achieved in a simple manner according to the invention by arranging the locking element outside of the connecting region, preferably by moving said element accordingly. This causes the locking element to no longer cover the connecting region, as a result of which the two support elements can be rotated relative to one another, for example using a corresponding joint.

The feature that the locking element is arranged outside the connecting region is to be understood to mean within the scope of the invention that the locking element does not prevent a rotation of the support elements relative to one another or that the locking element does not intersect a plane of the connecting region. The locking element is preferably moved in such a way that it is located above the connecting region and preferably extends no further downwards than the upper support element. This solution has the advantage that the locking element does not move into the release position by itself.

Alternatively, it can also be provided that the locking element is located in the release position below the connecting region, preferably in such a way that the locking element does not extend further upwards in the direction of the connecting region, like the lower support element.

In order to move the locking element, it is preferably provided that the locking element performs a movement that runs parallel to the longitudinal axis of the upper support element and/or the longitudinal axis of the lower support element, with the longitudinal axes of the support elements preferably being aligned coaxially to one another in the working position.

In order to bring the locking element into a release position, it is also conceivable for the locking element to be designed in two parts, with a first locking part being pushed upwards and a second locking part being pushed downwards in order to arrange the locking element as a whole outside of the connecting region. In this solution, it can be provided that the first locking part locks with the second locking part in the working position.

Due to the fact that the support means is designed to be rotatable or that it can rotate away, it is possible to rotate the ceiling formwork panels away without a collision.

The support means according to the invention also simplifies a removal or a mounting of the ceiling formwork panels from below in that the support means or the upper elongated support element is first rotated away. This means that a removal from below can be carried out effectively, efficiently, and safely.

The ceiling formwork panels can therefore be formed and removed from a safe position from below.

It is advantageous if, in the working position, the locking element extends from a lower end region of the upper support element to an upper end region of the lower support element and thereby bridges the connecting region.

Because the locking element extends from a lower end region of the upper support element to an upper end region of the lower support element, the connecting region can be bridged in a particularly advantageous manner which prevents the upper support element from being accidentally rotated out of the working position and also makes it possible to additionally stabilize the support elements in the working position.

It is also advantageous if, in the working position, the locking element rests at least in portions on an inner wall and/or an outer wall of the support elements.

Preferably, the locking element is in close contact with the inner wall and/or the outer wall of the support element.

The support elements are particularly advantageously stabilized due to the fact that the locking element rests at least in portions on an inner wall and/or an outer wall of the upper and lower support element in the working position. In one embodiment, the locking element can be designed in such a way that it surrounds the two support elements on the outside or bears against the outer walls of the support elements.

The locking element can, for example, be in the form of a rod or plate and can surround the support elements on the outside.

The locking element can have one or more locking members, for example a plurality of rod- or plate-shaped members. If necessary, the locking members can also be connected to one another, for example in order to form a cage which encompasses the support elements on the outside. In a particularly advantageous embodiment, which is explained in more detail below, it can be provided that the locking element is tubular or sleeve-shaped, for example as a support sleeve or a sliding sleeve.

In one embodiment, it can also be provided that the locking element bears against an inner wall of the support elements. For this purpose, the support elements can be tubular, for example. The locking element can be arranged within the tubular support elements. For operational purposes, it can be provided, for example, that one or both support elements have a slot through which an operating part, which is connected to the locking element arranged inside the tubular support elements, protrudes in order to move the locking element along the longitudinal axes of the support elements, in particular upwards and downwards.

It is advantageous if the locking element forms a guide with the support elements in order to move the locking element between the working position and the release position in a guided manner.

It has proven to be advantageous if the locking element and the support elements are designed in such a way that they form a guide in order to be able to move the locking element in a guided and defined manner from the working position into the release position. This can be a rail guide or a linear guide, for example. Other configurations, however, in particular form-fitting configurations, which allow for a defined movement of the locking element, preferably along the longitudinal axes of the support elements, in particular coaxially, from the working position into the release position are possible as well.

According to the invention, it can also be provided that the outer diameters of the support elements are substantially identical, preferably identical, at least in the end regions adjoining the connecting region.

It has been found to be advantageous if the support elements have an identical outer diameter or an identically designed outer circumference. It is particularly advantageous if the support elements have an identical outside diameter at least in the end regions in which they adjoin the connecting region, i.e., the upper end region of the lower support element and the lower end region of the upper support element. The loads can thus be advantageously absorbed and the locking element can also be moved particularly advantageously, in particular if the locking element is designed in such a way that it bears against the outer walls of the support elements, preferably in a circumferential manner.

In principle, it is also possible for the support elements to have different outside diameters. A provision can be made here, for example, for the lower support element to have a larger outside diameter than the upper support element. Insofar as it is provided that the locking element encloses the support elements on the outside, it can be provided that the locking element is designed as a sleeve with two different outer diameters so that, in the working position, the sleeve sits on the shoulder of the lower support element formed by the increase in diameter and can, in the release position, be moved upwards in the direction of the upper support element.

According to the invention, it can also be provided that the outer diameter of the connecting region is the same as or smaller than the outer diameter of the lower end region of the upper support element and/or the upper end region of the lower support element.

Because the outer diameter of the connecting region is the same size as or smaller than the outer diameter of one of the support elements or preferably both support elements, the locking element can be brought into the working position in a particularly simple manner in that the locking element bridges or covers the connecting region between the two support elements.

According to the invention, it can also be provided that the lower support element is a lower support tube and/or the upper support element is an upper support tube.

It has turned out to be particularly suitable if the support elements are designed as support tubes, i.e., that they have a tubular shape. The lower support element is thus preferably designed as a lower support tube and the upper support element as an upper support tube.

In order to simplify the description, reference is made below to a design of the support elements mainly as support tubes. However, it should be pointed out that the features shown with regard to the support tubes can also be provided in the case of a general design of the support tubes as support elements, unless this is structurally not feasible. Conversely, features that are mentioned with regard to the support elements are particularly and especially advantageously suitable if the support elements are support tubes.

The locking element provided according to the invention can be used in a particularly advantageous manner with support tubes, namely on the one hand in such a way that the locking element rests against an inner wall of the support tubes—at least in portions—and on the other hand in such a way that the locking element rests on an outer wall of the support tubes—at least in portions—to secure the support tubes against an unintentional rotation in the working position.

It is advantageous if the locking element is a movable support sleeve.

A locking element designed as a movable support sleeve has proven to be particularly suitable. A support sleeve can be designed in a simple manner in such a way that it bridges the connecting region in the working position and can be moved from there into a release position. The support sleeve can also be designed in a simple manner in such a way that it rests at least in portions on the outer walls of the end regions of the support elements in order to stabilize the support tubes in relation to one another in the working position. The formation of a guide between the locking element and the support elements in order to move the locking element in a guided manner between the working position and the release position is also possible in a simple manner.

The use of a support sleeve is suitable in a particularly advantageous manner if the support elements are support tubes.

The support sleeve is preferably designed as a sliding sleeve.

It is advantageous if, in the working position, the support sleeve encompasses the lower end region of the upper support tube and the upper end region of the lower support tube at least in portions on the outside, preferably in a tightly fitting manner.

Designing the support sleeve such that it encompasses the lower end region of the upper support tube and the upper end region of the lower support tube at least in portions on the outside has proven to be particularly suitable. The inner wall of the support sleeve preferably rests closely against the outer walls of the support tubes so that these are stabilized, particularly in the working position.

According to the invention, it can also be provided that the support sleeve is movable coaxially to the upper support tube and/or the lower support tube in order to bring the support sleeve into the release position.

It has proven to be particularly advantageous if the support sleeve and the support tubes are designed in such a way that the support sleeve can be moved or brought from the working position to the release position by a movement that runs coaxially to the support tubes, i.e., along the longitudinal axes of the support tubes. Such a movement is particularly easy to perform for the user.

It is also advantageous if the lower support tube has a stop, preferably a stop ring, on which a lower front end of the support sleeve rests in the working position.

The formation of a stop, in particular a stop ring or at least a partially ring-shaped stop segment, which runs completely around the lower support tube on the outside has proven to be particularly suitable for reliably defining the position that the support sleeve should assume in the working position. The stop can also advantageously be designed as a partially ring-shaped stop segment, particularly if the lower support tube has a cross section that deviates from the circular shape, in which case a plurality of stop segments can be provided as well.

According to the invention, it can be provided that the support sleeve has an operating element, for example a projection, an overhang or preferably an operating ring, which runs around the outside of the support sleeve, preferably in the shape of a ring or part of a ring, so that an operator can move the support sleeve in a particularly easy manner, in particular coaxially from the working position to the release position.

According to the invention, it can also be provided that the tilting angle between the upper support element and the lower support element in the tilted position is 5 to 90 degrees, preferably 10 to 80 degrees, more preferably 15 to 70 degrees, and particularly preferably 20 to 60 degrees, very particularly preferably 20 to 45 degrees, in particular 30 to 35 degrees, in particular 32.5 degrees.

The aforementioned values for the tilting angle, in particular an angle of 30 to 35 degrees, have proven to be particularly suitable in order to ensure that a support head which is formed on the upper support tube or which can be attached to the upper support tube can be rotated out of the rotation path of the ceiling formwork panels.

It is advantageous if the support means is designed in such a way that the support tubes can only assume two stable positions, the first position being the working position which is secured by the locking element, in particular the support sleeve, and the second position being the tilted position. This means that the two support tubes are either in the working position or are rotated out to the maximum and assume the tilted position, with the tilting angle relative to the working position being particularly preferably between 30 and 35 degrees, in particular 32.5 degrees.

According to the invention, it can also be provided that an upper front end of the lower support element has a bevel.

It has turned out to be particularly advantageous if an upper front end of the lower support element, in particular in an embodiment as a support tube, has a bevel, i.e., an angle cut.

The bevel or the angle cut makes it possible to bring the upper support element, in particular an upper support tube, from the working position into the tilted position in a particularly simple manner. A lower front end of the upper support element can rest in the tilted position on the bevel of the upper front end of the lower support tube. This results in a stable positioning of the support tubes in the tilted position.

It is advantageous if the bevel is designed in such a way that 40% to 90%, preferably 50% to 90%, in particular 50% to 75%, of the upper front end of the lower support element is provided with a bevel.

The aforementioned values for the beveling of the upper front end of the support element or the support tube have proven to be particularly suitable. Particularly in the case of an embodiment in which 50% to 60% of the upper front end is provided with a bevel, it has been shown that the rotating movement can be carried out particularly advantageously and that the non-beveled portion of the front end is still large enough in the working position to be able to absorb the compressive forces caused by the pouring of the concrete ceiling.

The rotating movement between the support tubes can be realized, for example, by a rotary joint, a ball joint, a hinge, or the like. It can also be advantageous if the rotating movement is realized by a slotted guide.

It is advantageous if the support tubes are rotatably connected to one another via an axis of rotation.

The connection of the support tubes via an axis of rotation has proven to be particularly advantageous since this allows for a defined movement to be implemented which is not susceptible to damage either.

It is advantageous if one of the support tubes has holes, preferably elongated holes, in order to fix the axis of rotation.

Fixing the axis of rotation in holes, preferably elongated holes, in a support tube has proven to be particularly suitable for achieving a reliable and safe rotation of the support tubes. The design of the holes as elongated holes makes it possible in an advantageous manner that a lifting movement can also be carried out when the upper support tube is rotated from the working position into the tilted position. This facilitates the rotation process.

The elongated holes allow for or support an advantageous rotation of the upper support tube in relation to the lower support tube. To this purpose, the upper support tube is moved vertically a little or a small distance along the length of the elongated holes, resulting in a height difference compensation during the tilting.

The elongated holes also prevent forces from being transmitted to the axis of rotation that pass through the elongated holes. For this purpose, it is preferably provided that the axis of rotation always has vertical play in the elongated holes. The axis of rotation is arranged in the elongated holes in such a way that no forces, in particular no compressive forces, act on it when the support head is in the working position, i.e., is not rotated. The axis of rotation and the elongated holes are therefore designed in such a way that the axis of rotation in the elongated holes has vertical play in the upward and preferably also the downward direction in the working position.

This ensures that the compressive forces are only transmitted from the upper support tube to the lower support tube.

The axis of rotation is preferably designed as a bolt.

According to the invention, it can also be provided that a connecting element is fixed to one of the support tubes, preferably to an inner wall of the support tube, and that the connecting element has one or more holes through which the axis of rotation fixed to the other support tube is guided in such a way that the connecting element can be rotated about the axis of rotation.

Because a connecting element is fixed to one of the support tubes and it has holes through which the axis of rotation, which is fixed to the other support tube, can be passed, a particularly stable and safe rotating movement can be implemented, which has been found to be particularly useful when the support means is used in a robust application on a construction site. The connecting element can have any suitable shape, preferably such that the connecting element can be fixed to an inner wall of the support tube, preferably such that the connecting element can be fixed to two opposite inner wall sides of the support tube.

For this purpose, the connecting element and the support tube can have corresponding fastening holes by means of which the connecting element can be connected to the support tube.

The connecting element can preferably be a profile element, in particular with a design that is substantially rectangular in the cross section, wherein the outer contour can optionally be adapted to the curvature of the inner wall of the support tube, and it suffices if the side edges of the connecting element running in the longitudinal direction are flattened or provided with a radius. The connecting element can preferably be tubular.

It is advantageous if an outer contour of the connecting element is adapted at least in portions to an inner contour of the upper support element, preferably in such a way that the outer contour rests against the inner contour of the upper support element in at least two portions, preferably three portions, preferably in such a way that at least 5% of the outer contour of the connecting element rests against the inner contour of the upper support element.

The aforementioned embodiment has been found to be advantageous to ensure a secure connection of the connecting element to the upper support element. It can be provided that the outer contour of the connecting element and the inner contour of the upper support element are designed in such a way that the connecting element is secured against rotation in the upper support element.

According to the invention, it can also be provided that the connecting element has at least two, preferably exactly two, surfaces that run parallel and are spaced apart, in each of which one of the holes is placed such that the holes guide the axis of rotation in a defined manner.

The connecting element can also be designed as a hinge or as a T-profile.

It is advantageous if an outer circumference of the lower support tube and/or an outer circumference of the upper support tube and an inner circumference of the support sleeve have a circular cross section or a noncircular cross section, preferably a lemon-shaped cross section (lemon shape), a rectangular cross section, a triangular cross section, a triangular lemon-shaped cross section, a star-shaped cross section, or a polygonal cross section.

The lower support tube and the upper support tube as well as the support sleeve designed in such a way that they have a circular cross section can be achieved in a particularly simple and cost-effective manner. However, it has proven to be advantageous if the outer circumference of the lower support tube and/or the outer circumference of the upper support tube and the inner circumference of the support sleeve have a cross section that deviates from the circular shape. This has the advantage that the support sleeve, the inner circumference of which rests, preferably tightly, against the outer circumference of the support tubes in the working position, can absorb torsional forces so that the support sleeve largely prevents the support tubes from twisting relative to one another. In particular, this prevents the connection provided for the rotation between the two support tubes, in particular an axis of rotation, from being loaded with forces that could lead to damage.

The noncircular cross section may preferably be a lemon-shaped cross section. An elliptical cross section, any polygonal cross section, in particular a triangular cross section or a quadrangular cross section, in particular a rectangular cross section, is possible as well, however.

According to the invention, it can also be provided that an outer diameter of the upper support tube and/or the lower support tube with a circular cross section is 40 to 80 mm, preferably 40 to 70 mm, in particular 40 to 60 mm, preferably 50 mm+/−2 mm, or that, with a noncircular cross section, the length of a long axis of the cross section of the upper support tube and/or the lower support tube is 40 to 80 mm, preferably 40 to 70 mm, in particular 40 to 60 mm, preferably 51 mm+/−2 mm, and that the length of a short axis of the cross section is 5 to 25 mm, preferably 17 mm+/−2 mm, shorter.

The aforementioned values for the outer diameter of the upper support tube and/or the lower support tube have proven to be particularly suitable for the support means to be able to absorb the forces that occur and make an advantageous rotation of the upper support tube into the tilted position possible. Other values are also possible here, of course.

It is advantageous if the wall thickness of the upper support tube and/or the wall thickness of the lower support tube and/or the wall thickness of the support sleeve is 2 to 8 mm, in particular 3 to 6 mm, preferably 3 to 5 mm, in particular 3.5 to 4.5 mm.

The aforementioned values have proven to be suitable for enabling the support means to absorb the forces in a suitable manner.

It is advantageous if the support tubes together have a length of 200 to 600 mm, preferably 300 to 500 mm, in particular 350 to 450 mm.

The aforementioned values for an overall length of the upper and lower support tube have proven to be particularly suitable. The above values are also generally suitable for an upper support element and a lower support element.

It is advantageous if the upper support tube has a length which is at least 1.5 times, preferably 2 times, the length of the lower support tube and/or if the length of the upper support tube is less than 4 times, preferably is less than 3 times the length of the lower support tube.

The aforementioned values have also turned out to be particularly suitable for ensuring the most stable design of the support means and for making it possible that the upper support tube can be rotated out in such a way that a support head is no longer in the rotation path of the ceiling formwork panel when the latter is being removed or positioned.

It is advantageous if the lower support tube is designed as a support foot; i.e., in addition to a tubular design, a preferably plate-shaped support is provided as well. The plate-shaped support can be welded to the support tube or connected in another manner, preferably with a material fit. A one-piece design is possible as well. The plate can have holes with the help of which the plate and thus the support leg can be easily and detachably fixed to the top of a ceiling support. The plate can thus be designed as an adapter surface or as an adapter element.

It is advantageous if a spindle device is provided in order to change the overall length of the support means and the ceiling support.

Spindle devices for changing the length of a ceiling support are known principally from the prior art. In particular, these can be so-called head spindles. The spindle device can be formed either on the ceiling support or on the support means or also on an extension of the ceiling support. The function of the spindle device is to change the overall length of the support means and the ceiling support, in particular to ensure that a support head fixed to the support means can be raised and lowered, in particular to bring said support head into engagement with the ceiling formwork panels.

It is advantageous if the upper end region of the upper support element or that a support head for the ceiling formwork panel is formed on an upper end region of the upper support element.

It has proven to be particularly suitable if an upper end region of the support element comprises an upper adapter element to which a support head for the ceiling formwork panel can be fixed. The upper adapter element can preferably be designed in the form of a plate and preferably have a plurality of holes to which the correspondingly designed support head can be fixed. This solution makes it possible to use the support means with different support heads. The support heads can be designed for the corresponding intended task and, in particular, can be adapted to the corresponding ceiling formwork panel. The support heads can be, in particular, a support head made of steel or polymer but also a so-called lowering head preferably made of steel.

In an alternative embodiment, it can also be provided that the support head is formed in one piece with the upper end region of the upper support element; i.e., the support head is permanently connected to the upper end region of the upper support element.

It is advantageous if a lower end region of the lower support element has a lower adapter element for a detachable attachment to the ceiling support or if the ceiling support, an extension of the ceiling support, or a spindle device is formed on a lower end region of the lower support element.

It is advantageous if the lower end region of the lower support element has a lower adapter plate, by means of which the lower support element can be detachably fastened to the ceiling support. The lower adapter element can preferably be designed as a plate. In particular, as already mentioned above, it can be provided that the lower support element is designed as a support foot and thus already has the lower adapter element. The lower adapter element makes it possible to connect the support means to a ceiling support and to release said support again as needed.

Alternatively, it can also be provided that the ceiling support, an extension of the ceiling support, or a spindle device, for example a head spindle, is designed in one piece or cannot be detached from a lower end region of the lower support element.

It is advantageous if the support means is designed as an adapter and/or as an attachment for a detachable connection to an upper end of the ceiling support.

This solution has proven to be particularly suitable for using the support means as required and connecting said means accordingly to a ceiling support.

Correspondingly, it can also be provided that the support means is designed as an adapter and/or as an extension or as an attachment for the detachable connection with a support head. The support means can thus be connected to a support head or detached from said support head again as needed.

Within the scope of the invention, it can also be provided that the support means has a support head or the support head is part of the support means.

The present invention also relates to a ceiling support with a support means, wherein the support means preferably has one or more of the aforementioned features.

In the case of the ceiling support, it can be provided that the support means is detachably fixed to an upper end of the ceiling support or is designed in one piece with the ceiling support.

It is advantageous if the ceiling support has a spindle device or if a spindle device is provided in order to raise or lower the support means.

The present invention also relates to a ceiling formwork system having at least one ceiling formwork panel, at least one ceiling support, and at least one support means for the ceiling support, the support means preferably having one or more of the aforementioned features.

The invention also relates to a method for removing a ceiling formwork panel that is supported by at least one ceiling support, according to which the ceiling support is first lowered by means of a spindle device to such an extent that a support head, to which the ceiling support is connected via a rotatable support means, disengages from the ceiling formwork panel, according to which the support head is then rotated, by means of the support means, by a tilting angle in such a way that the support head is not in a rotation path of the ceiling formwork panel when said panel is rotated downwards about an axis of rotation that runs along a side edge of the ceiling formwork panel that is not adjacent to the ceiling support.

The method according to the invention has turned out to be particularly suitable for removing a ceiling formwork panel safely and reliably. Thus, the method according to the invention can also be used to mount a ceiling formwork panel from below or to position it. For this purpose, the support head is first rotated or tilted away, and then the ceiling formwork panel is rotated up. After the ceiling formwork panel has been rotated up, the support head is then rotated into a working position and brought into engagement with the ceiling formwork panel, preferably by means of a spindle device.

The support means, which carries the support head, can preferably be designed in the manner described above with regard to the support means according to the invention.

The method according to the invention is not limited to a use of the support means according to the invention but can also be carried out with other rotatable support means.

It is advantageous if, in order to rotate the support head, a locking element which bridges a connecting region between an upper support element and a lower support element is moved from a working position in which the locking element secures the support elements against rotation to a release position in which the locking element is arranged outside of the connecting region, preferably such that the locking element is moved coaxially to the support elements. The support elements are preferably support tubes of the type already described above.

Within the scope of the method according to the invention, it is advantageous if the upper support element is rotated about an axis of rotation that is fixed to the lower support element in order to bring the upper support element into the tilted position.

The method according to the invention for removing a ceiling formwork panel can preferably have one or more of the following work steps. For clarity purposes, a distinction is made below between a left ceiling support and a right ceiling support with the use of the terms only being exemplary in order to clarify the principle.

In a first (optional) work step, a left ceiling support and, together with said support, a support means is lowered by 10 to 50 mm, preferably by about 25 mm, preferably by means of a spindle device, in particular having a spindle nut.

In a second step, a right ceiling support and, together with said support, a support means is lowered by 25 mm to 100 mm, preferably 35 mm to 70 mm, particularly preferably 40 mm to 55 mm, in particular by approximately 50 mm, by means of a spindle device, preferably having a spindle nut. They can be lowered over a longer distance as well, for example up to 500 mm, but this is not to be preferred since lowering over a smaller distance is advantageous.

In a third step, the right side of the ceiling formwork panel is raised again by using a positioning aid, preferably until the panel edge touches the concrete ceiling. As a result, the engagement between a support head of the right ceiling support fixed to the support means and the ceiling formwork panel is released. The support head of the support means of the right ceiling support is therefore released.

In a fourth step, a support sleeve of the released support means is moved upwards such that the support sleeve is in the release position. This makes it possible to rotate an upper support tube or the support head away.

In a fifth step, the support head or the upper support tube is rotated by applying a force, in particular a horizontal force, in the direction "away from the positioned ceiling formwork panel" until it is in the tilted position or until it arrives at a stop. The support head is rotated outwards to such an extent that the support head is preferably no longer located below the ceiling formwork panel, which is to be lowered or rotated away after the support head has been rotated away. At least the support head is rotated outwards until it is no longer in the lowering or rotation path of the ceiling formwork panel.

In a sixth step, the ceiling formwork panels are rotated into a vertical position using the positioning aid. The ceiling formwork panel rotates about an axis of rotation that runs along a side edge of the ceiling formwork panel that is not adjacent to the ceiling support, the support means of which was rotated into the tilted position.

The axis of rotation results in a known manner from the fact that the ceiling formwork panels are also hooked into at least one, two, or more ceiling supports, in the exemplary embodiment into two left ceiling supports, namely a front left ceiling support and a rear left ceiling support, which together provide an axis of rotation when the right ceiling support, usually two right ceiling supports, namely a front right ceiling support and a rear right ceiling support, as described above, is lowered and their support means are rotated outwards.

The measures described above are usually carried out on two left ceiling supports and two right ceiling supports.

The above measures can also be carried out on two rear and two front ceiling supports.

Ceiling formwork panels usually have a rectangular shape, preferably with a side length of 2 m by 1 m.

With the method according to the invention, a ceiling formwork panel can be rotated both on the short side and on the long side; i.e., the axis of rotation runs both on a short side of the rectangular ceiling formwork panel and on a long side of the ceiling formwork panel. The support heads of the ceiling supports that are not adjacent to the axis of rotation are tilted outwards, as described above, in such a way that they are not in the rotation path when the ceiling formwork panel is rotated downwards. As a rule, there are two ceiling supports, the support heads of which are rotated outwards accordingly, but it can also be provided that more than two ceiling supports or just one ceiling support are positioned on the corresponding side.

The method according to the invention for removing a ceiling formwork panel has been described above with reference to the support means according to the invention. In principle, however, the method according to the invention can be realized with any rotatable support means that is suitable for rotating the support head in such a way that the support head is not in a rotation path of the ceiling formwork panel when the latter is rotated downwards about an axis of rotation that runs along a side edge of the ceiling formwork panel that is not adjacent to the ceiling support.

Features that have been described in connection with one of the objects of the invention, specifically the support means, the ceiling support, the ceiling formwork panel, and the removal method, can also be advantageously realized for the other objects of the invention. Advantages that were mentioned in connection with one of the objects of the invention, specifically the support means, the ceiling support, the ceiling formwork panel, and the removal method, can also be understood as relating to the other objects of the invention.

In addition, it should be pointed out that terms such as "comprising," "having," or "with" do not exclude any other features or steps. Furthermore, terms such as "one" or "the" which refer to a single number of steps or features do not exclude a plurality of features or steps—and vice versa.

DETAILED DESCRIPTION

Figure 1:
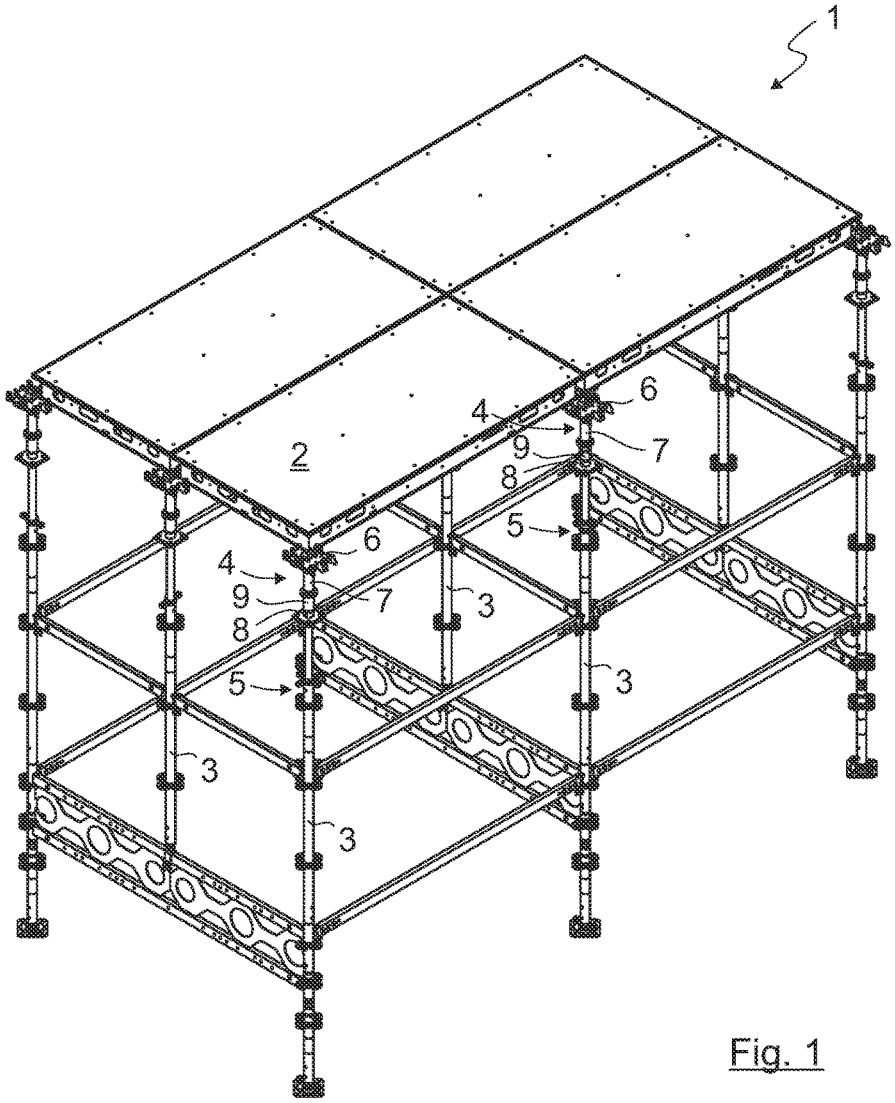
FIG. 1A perspective view of a ceiling formwork system, in which four ceiling formwork panels are shown as an example, which are supported by nine ceiling supports which are each provided with the support means according to the invention.
Figure 2:
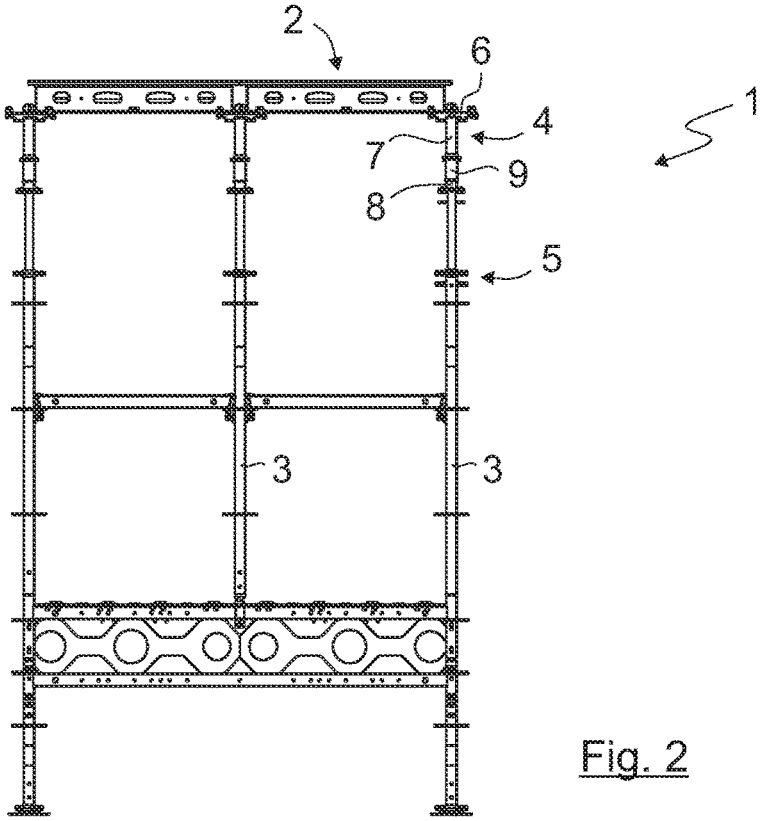
FIG. 2A side view of the ceiling formwork system of FIG. 1.

Ceiling formwork systems, ceiling formwork panels, ceiling supports, and support heads and their mode of operation are known in principle from the general prior art, for example DE 10 2018 203 612 A1 and WO 2018/233993 A1, which is why only the features that are essential to the invention will be discussed in more detail below.

FIGS. 1 to 5 show a ceiling formwork system 1, in which four ceiling formwork panels 2 and a plurality of ceiling supports 3 are shown as an example.

The ceiling formwork panels 2 form a formwork in order to be able to create or pour a ceiling, in particular a floor ceiling, in particular made of concrete.

A support means 4 according to the invention is detachably fixed to an upper end of the ceiling supports 3. The support means 4 can also be designed in one piece with the ceiling support 3, in particular the upper end of the ceiling support 3.

In the exemplary embodiment according to FIG. 1 to FIG. 5, it is provided by way of example that each of the ceiling supports 3 shown there is provided with a support means 4 according to the invention. This is optional, however. If necessary, ceiling supports that are not provided with a support means 4 according to the invention can be used as well.

The ceiling supports 3 shown in FIG. 1 to FIG. 5 have a spindle device 5 in order to raise or lower the support means 4 as needed. Such spindle devices 5 are principally known from the prior art and typically have a spindle nut, by means of which the overall length of the ceiling support 3, in particular the support means 4, can be lengthened or reduced.

At their upper end, the ceiling supports 3 have a fastening element, preferably a fastening plate, to which the support means 4 can be fixed, preferably in a detachable manner, as will be explained in more detail below.

Figure 21:
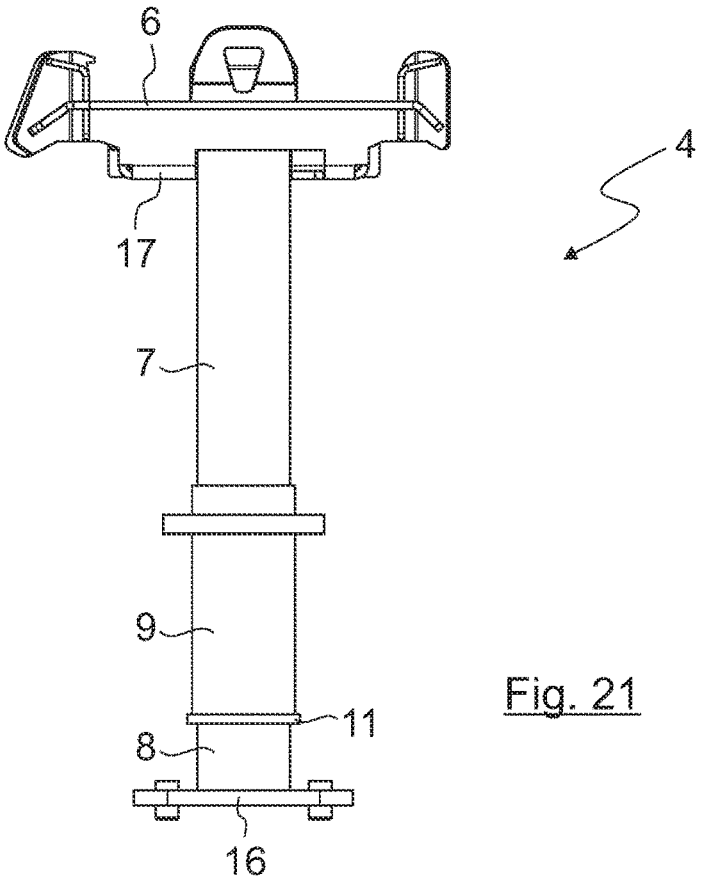
FIG. 21 An illustration of a support means, wherein the upper support tube is connected to a support head.

A support head 6 is arranged at an upper end of the support means 4 and engages in a basically known manner in a ceiling formwork panel 2 in order to hold said panel in position. In the exemplary embodiment, the support head 6 is detachably connected to the support means 4. Alternatively, however, the support head 6 can also be formed in one piece with the support means 4. A possible embodiment of a support head 6 is also shown in FIG. 21.

FIG. 6 to FIG. 23 show two advantageous embodiments of the support means according to the invention. In both embodiments, it is provided that the support head 6 can be releasably connected to the support means 4. However, the two exemplary embodiments are to be understood in such a way that the support head 6 can also be designed in one piece with the support means 4.

In principle, the support head 6 can be part of the support means 4.

As can be seen from FIG. 6 to FIG. 23, the support means 4 according to the invention has at least one upper elongated support element 7 and one lower elongated support element 8. The support elements 7, 8 are rotationally connected to each other.

FIG. 6 to FIG. 14 show an illustration of the support elements 7, 8 in a working position. In the working position, the longitudinal axes of the support elements 7, 8 preferably run parallel to one another so that the weight forces to be absorbed by the ceiling to be poured can be absorbed in an advantageous manner. In the exemplary embodiment, it is provided that the support elements 7, 8 or their longitudinal axes are aligned coaxially with one another.

Figure 15:
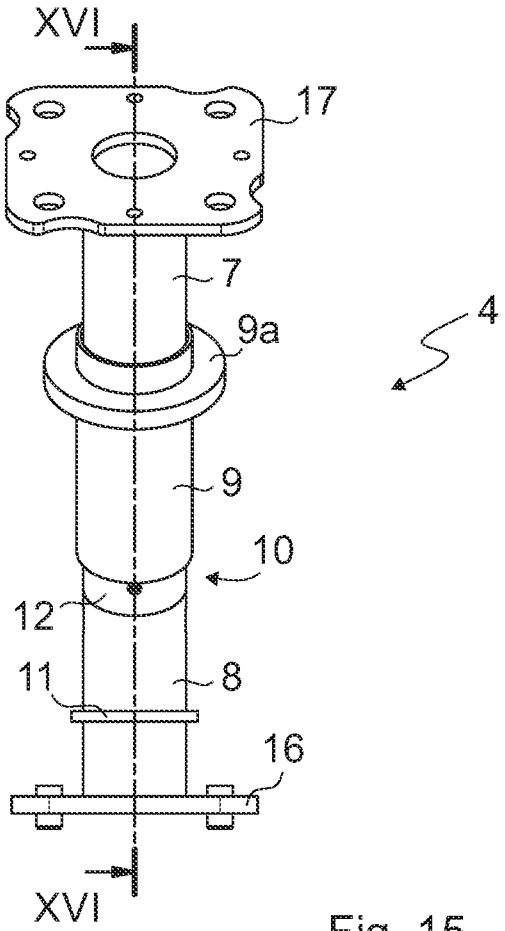
FIG. 15 An illustration of a support means in a second embodiment in a tilted position, wherein the support tubes and the support sleeve have a circular diameter.
Figure 16:
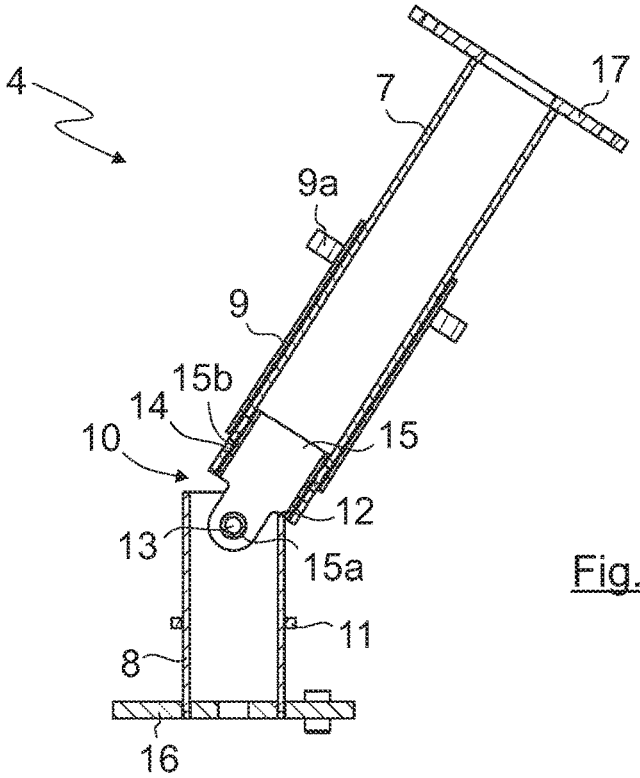
FIG. 16 An illustration according to the XVI-XVI line of FIG. 15.
Figure 17:
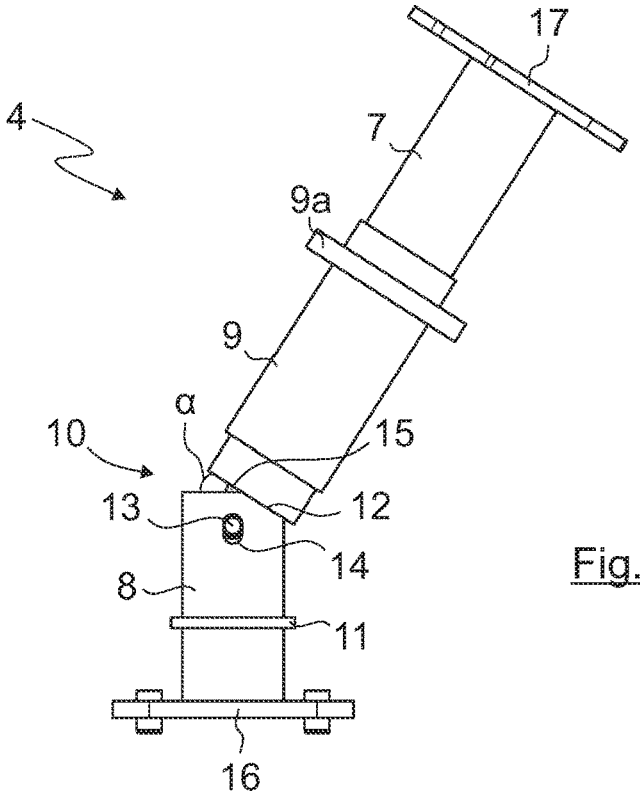
FIG. 17A side view of the support means according to FIG. 15.
Figure 18:
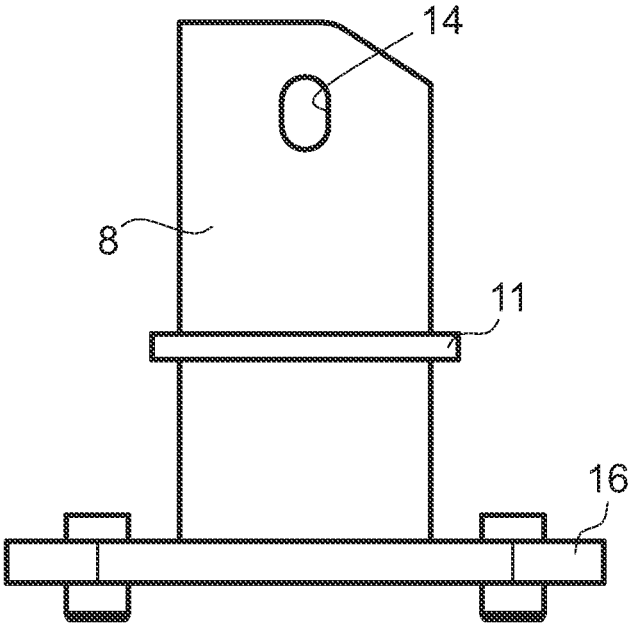
FIG. 18 An individual illustration of a lower support tube and a lower adapter element in a side view with an illustration of the bevel at the upper front end of the lower support tube.
Figure 19:
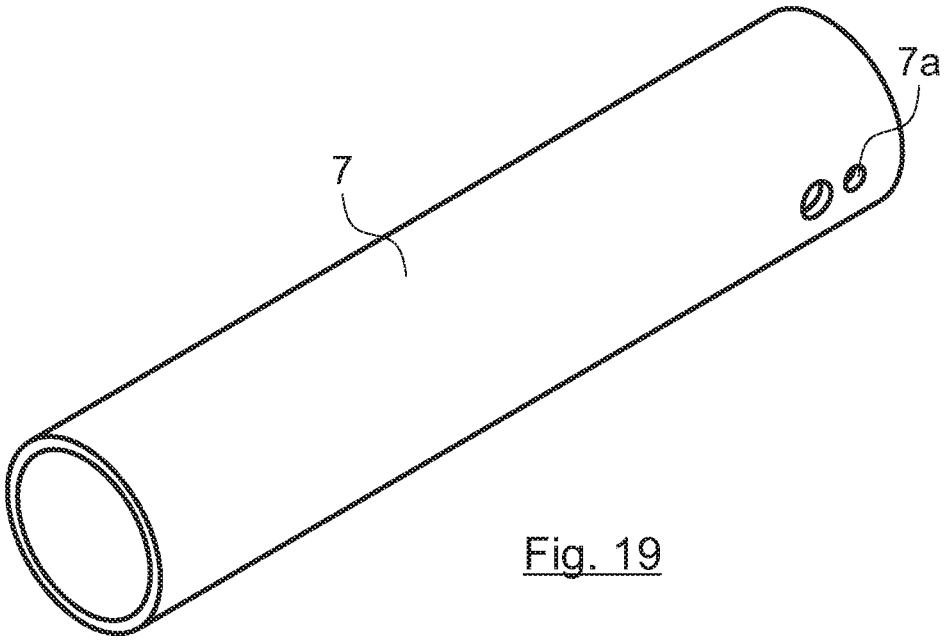
FIG. 19A perspective view of an upper support tube with a circular cross section.

The support elements 7, 8 can be rotated into a tilted position in which the support elements 7, 8 are rotated with respect to one another by a tilting angle $\alpha$. FIG. 15 to FIG. 17 show the support elements 7, 8 in the tilted position.

In the exemplary embodiment, it is provided that the upper support element 7 is tilted while the position of the lower support element 8 remains unchanged, i.e., as before in the working position.

Figure 5:
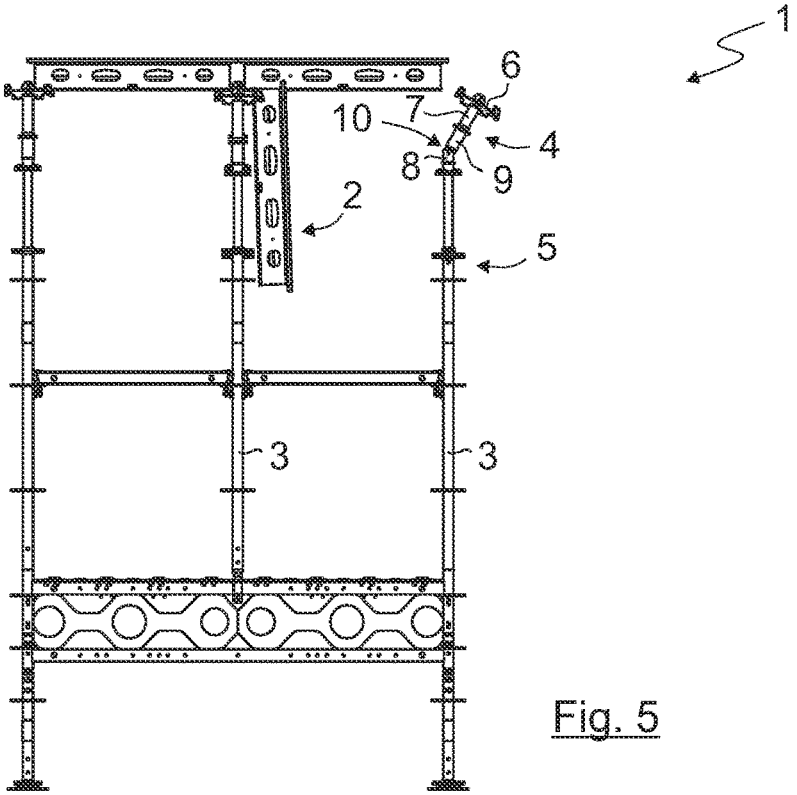
FIG. 5 An illustration according to FIG. 4, with a support head connected to the support means being rotated to the right into a tilted position and the ceiling formwork panel being lowered.
Figure 6:
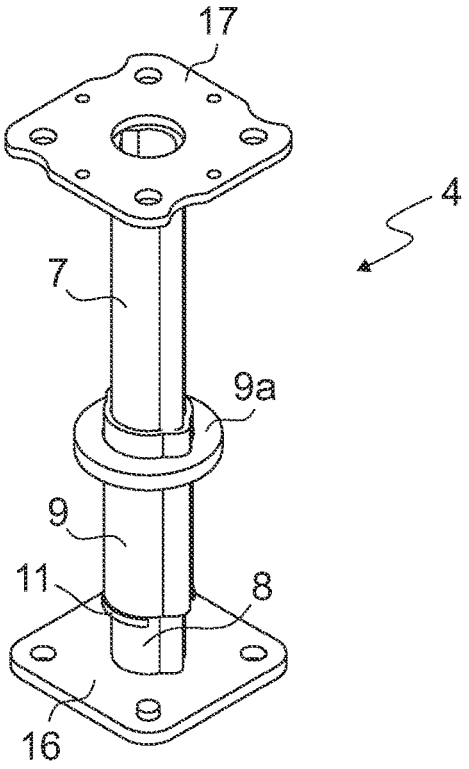
FIG. 6A perspective view of the support means according to the invention in a first embodiment.
Figure 7:
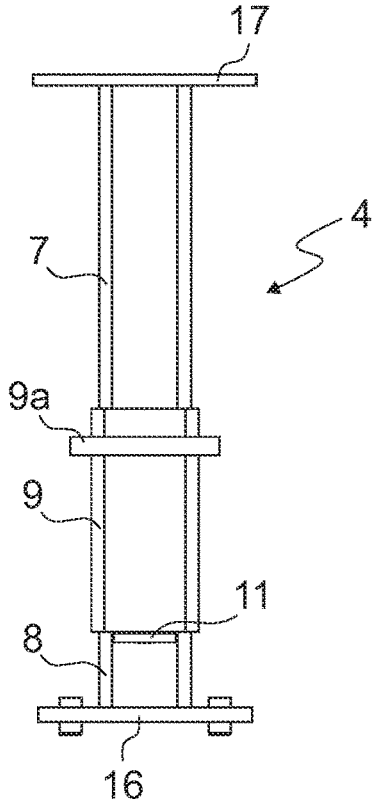
FIG. 7A side view of the support means according to FIG. 6.
Figure 8:
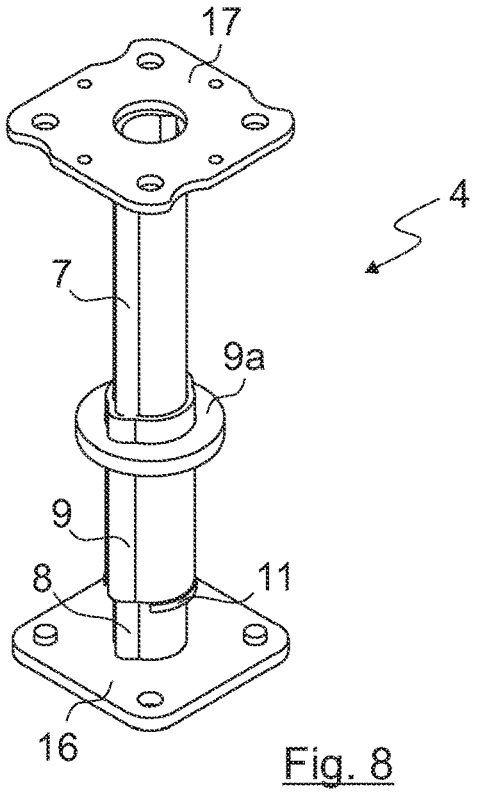
FIG. 8 Another perspective view of the support means according to FIG. 6.
Figure 9:
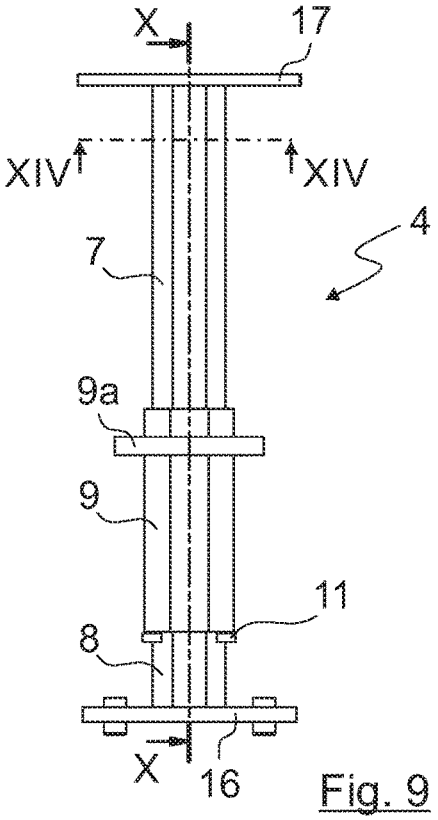
FIG. 9 Another side view of the support means according to FIG. 6.

FIG. 5 shows how a support head 6 can be rotated outwards when the support elements 7, 8 are rotated relative to one another into a tilted position.

The support means 4 according to the invention has a locking element 9 which secures the support elements 7, 8 against a rotation in the working position.

FIG. 6 to FIG. 13 and FIG. 21 show the locking element 9 in the working position, in which it secures the support elements 7, 8 against rotation. As can be seen from the figures, the locking element 9 bridges a connecting region 10 between the two support elements 7, 8 in the working position. The connecting region 10 or the articulated connection between the upper support element 7 and the lower support element 8 is thus covered by the locking element 9 in such a way that the support elements 7, 8 cannot be rotated or are not rotatable into the tilted position.

As can be seen from FIG. 15 to FIG. 17 and FIG. 22, the locking element 9 can be brought into a release position, in which the locking element 9 is arranged outside the connecting region 10, i.e., in which the locking element 9 no longer bridges the connecting region 10 or releases the same.

In the exemplary embodiment, it is provided for this purpose that the locking element 9 is moved upwards from the working position until it has reached the release position, i.e., until the locking element 9 is outside of the connecting region 10.

In the exemplary embodiment, it is provided that the locking element 9 extends into the working position from a lower end region of the upper support element 7 to an upper end region of the lower support element 8 and thereby bridges the connecting region 10.

The exemplary embodiment also provides that the locking element 9 and the support elements 7, 8 are designed in such a way that the locking element 9 rests against an inner wall and/or an outer wall of the support elements 7, 8 in the working position. The exemplary embodiment shows that the locking element 9 rests against the outer walls of the support elements 7, 8 in the working position.

It is also provided in the exemplary embodiment that the locking element 9 forms a guide with the support elements 7, 8 in order to move the locking element 9 between the working position and the release position in a guided manner. This is preferably a linear guide that allows for the locking element 9 to be moved along the longitudinal axes of the support elements 7, 8, in particular in a coaxial manner.

Figure 22:
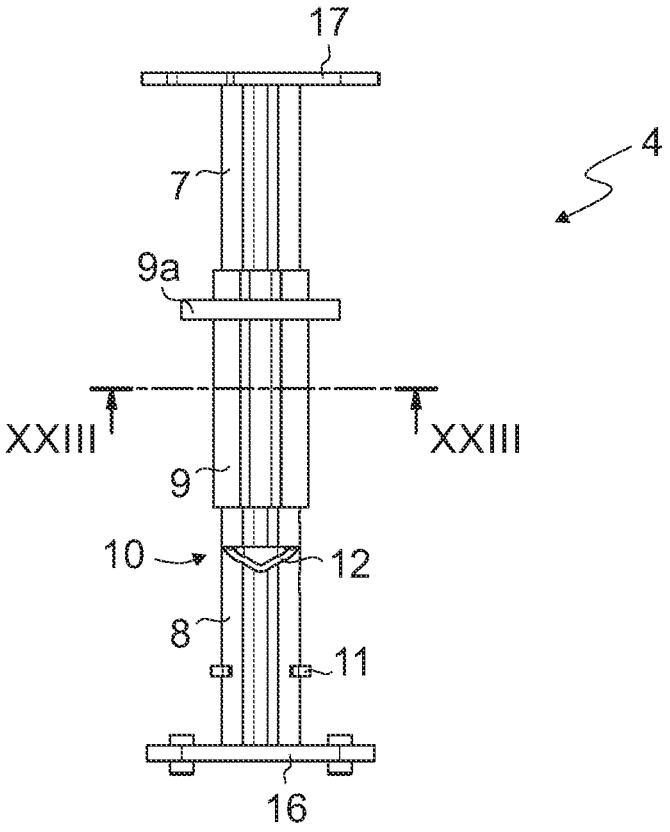
FIG. 22A side view of a support means according to FIG. 6, with the support sleeve being raised to the release position.
Figure 23:
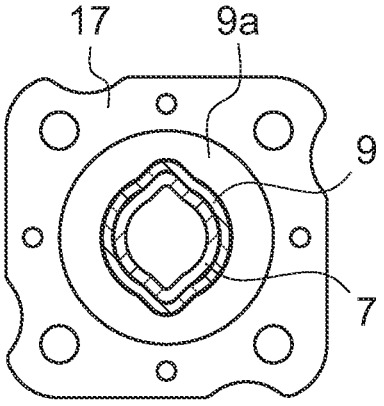
FIG. 23A sectional view along the XXIII-XXIII line of FIG. 22.

In the embodiment shown in FIG. 6 to FIG. 13 as well as FIG. 22 and FIG. 23, it is provided that the locking element 9 and the support elements 7, 8 are designed such that, in addition to forming a linear guide, a guide is formed that secures the locking element 9 against rotation relative to the support elements 7, 8.

In the exemplary embodiments, it is provided that the outer diameters or the outer circumferences of the support elements 7, 8 are identical at least in the end regions of the support elements 7, 8 adjoining the connecting region 10. This makes it possible to move the locking element 9 back and forth between the working position and the release position in a particularly easy manner.

The exemplary embodiment also provides that the outside diameter of the connecting region 10 is the same as or smaller than the outside diameter of the lower end region of the upper support element 7 and/or the upper end region of the lower support element 8.

The features in the exemplary embodiment are to be understood in such a way that the support elements 7, 8 and also the locking element 9 can be designed as desired within the scope of the disclosure. The exemplary embodiment shows, however, a particularly preferred embodiment of the support elements 7, 8 and the locking element 9. The specific disclosure in the exemplary embodiment, however, is also to be understood as a general disclosure for a configuration of the support elements 7, 8 and the locking element 9.

In the exemplary embodiment, the upper support element is in the form of an upper support tube 7 and the lower support element is in the form of a lower support tube 8. Furthermore, the locking element is designed in the exemplary embodiment as a movable support sleeve 9.

The support sleeve 9 can also be a sliding sleeve.

The support sleeve 9 is designed such that, in the working position, as shown in FIG. 6 to FIG. 13, it encompasses, preferably tightly, the lower end region of the upper support tube 7 and the upper end region of the lower support tube 8, at least in portions. In the exemplary embodiment, the support sleeve 9, when in the working position, completely surrounds the lower region of the upper support tube 7 and the upper end region of the lower support tube 8 on the outside.

In the exemplary embodiments, the support sleeve 9 can be moved coaxially with respect to the upper support tube 7 and the lower support tube 8 in order to bring the support sleeve 9 into the release position.

In order to be able to move the support sleeve 9 in an easy manner, it preferably has an operating element, in particular an operating ring 9*a*, that runs about the outer wall of the support sleeve 9.

As can also be seen from the exemplary embodiments, the lower support tube 8 has a stop against which a lower front end of the support sleeve 9 rests in the working position. In the exemplary embodiment, the stop is designed as a stop ring 11 (e.g., FIG. 18) which runs about the outer circumference of the lower support tube 8 in the form of a ring or part of a ring.

Figure 4:
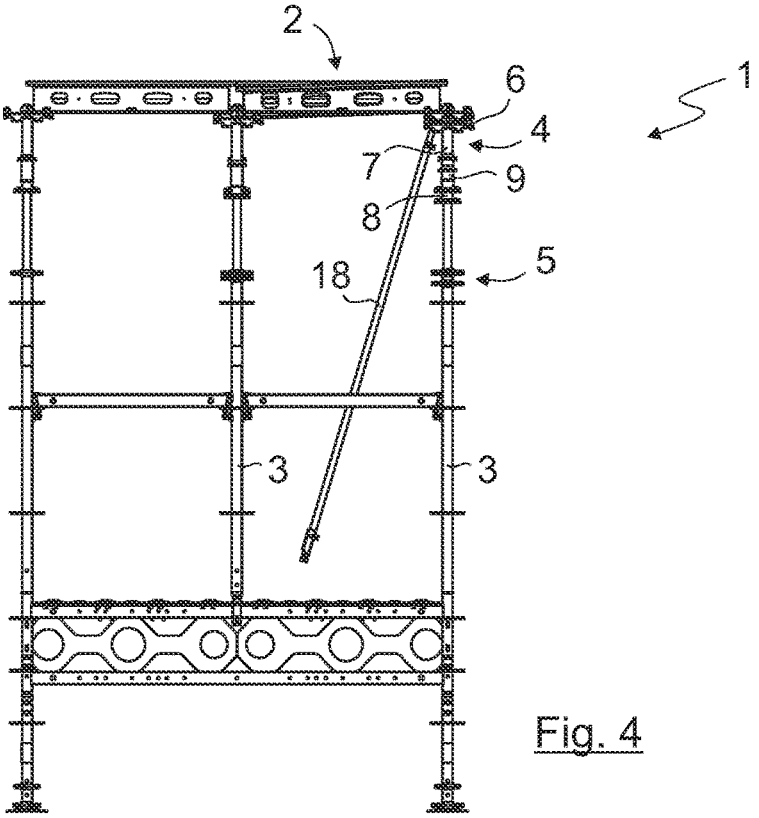
FIG. 4 An illustration according to FIG. 3, with the support means of the right front ceiling support being lowered, with an illustration of a positioning aid which supports the ceiling formwork panel on the right side edge.

The tilting angle $\alpha$ between the upper support element 7 and the lower support element 8 in the tilted position can be selected in such a way that it is ensured that the support head 6 is rotated outwards until the ceiling formwork panel 2, as shown in principle in FIG. 4 and FIG. 5, can be rotated downwards. It has proven to be particularly suitable if the tilting angle $\alpha$ is 5 to 90 degrees, preferably 10 to 80 degrees, more preferably 15 to 70 degrees, and particularly preferably 20 to 60 degrees, very particularly preferably 20 to 45 degrees, in particular 30 to 35 degrees, specifically 32.5 degrees. In the exemplary embodiment, an angle of 32.5 degrees is provided.

In the exemplary embodiment, no further intermediate positions are provided between the working position and the tilted position in which the support tubes 7, 8 are fixed or can be fixed to one another.

In the working position, the support tubes 7, 8 are fixed to one another by means of the support sleeve 9. In the tilted position, the support tubes 7, 8 are, due to gravity, in a stable position, which can be undone again by raising the upper support tube 7, preferably by hand, so that the upper support tube 7 runs again coaxial with the lower support tube 8 and can be secured by the support sleeve 9 in this position.

In the exemplary embodiment, the tilted position results from the fact that an upper front end of the lower support tube 8 has a bevel 12 or an angle cut. The bevel 12 is designed in such a way that 40% to 90%, preferably 50% to 90%, in particular 50% to 75%, of the upper front end of the lower support tube 8 is not provided with a bevel 12.

The bevel 12 can be seen particularly well in FIGS. 10, 11, 16 to 18, and 22. In the tilted position, a lower front end of the upper support tube 7 rests against the bevel 12, resulting in a stable positioning of the two support tubes 7, 8 in the tilted position.

In the exemplary embodiment, it is provided that the support tubes 7, 8 are rotatably connected to one another via an axis of rotation 13. For this purpose, it is provided that one of the support tubes, in the exemplary embodiment the lower support tube 8, has holes 14 in order to fix the axis of rotation 13. The holes are designed as elongated holes 14 in the embodiment.

The elongated holes 14 facilitate or support an advantageous rotation of the upper support tube 7 relative to the lower support tube 8. For this purpose, the upper support tube 7 is moved vertically to a slight degree or a small distance along the length of the elongated holes 14, resulting in a height difference compensation when tilted.

The elongated holes 14 also prevent forces from being transmitted to the axis of rotation 13 that passes through the elongated holes 14. For this purpose, it is preferably provided that the axis of rotation 13 always has vertical play in the elongated holes 14. The axis of rotation 13 is arranged in the elongated holes 14 in such a way that no forces, in particular no compressive forces, act on it when the support head 6 is in the working position, i.e., when it is not rotated. The axis of rotation 13 and the elongated holes 14 are therefore designed in such a way that the axis of rotation 13 has, in the working position, vertical play in the elongated holes 14 in the upward and preferably also in the downward direction.

This ensures that the compressive forces are only transmitted from the upper support tube 7 to the lower support tube 8.

The axis of rotation 13 is preferably designed as a bolt.

Figure 10:
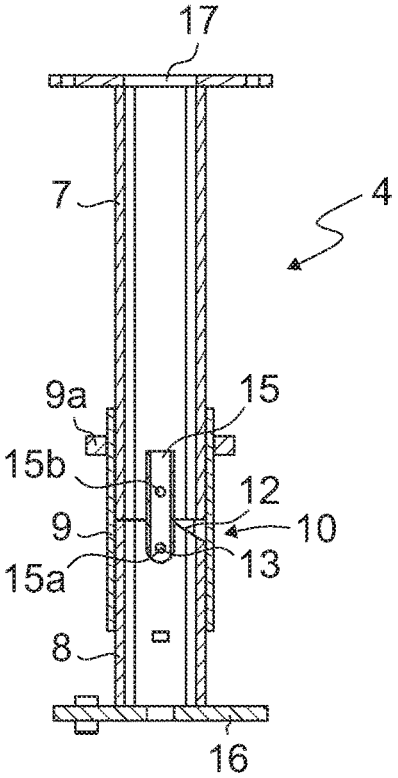
FIG. 10A section along the X-X line of FIG. 9.
Figure 11:
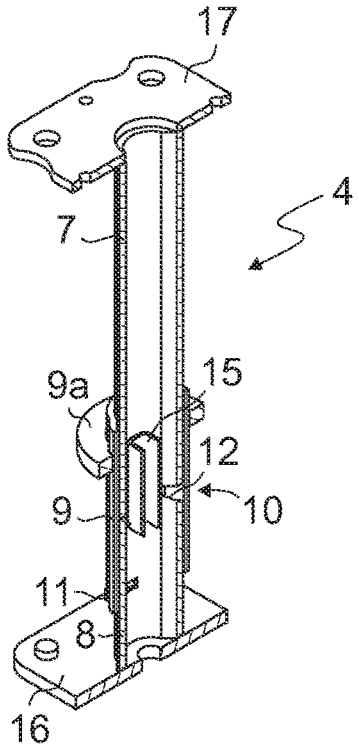
FIG. 11A perspective view of the sectional view of FIG. 10.
Figure 12:
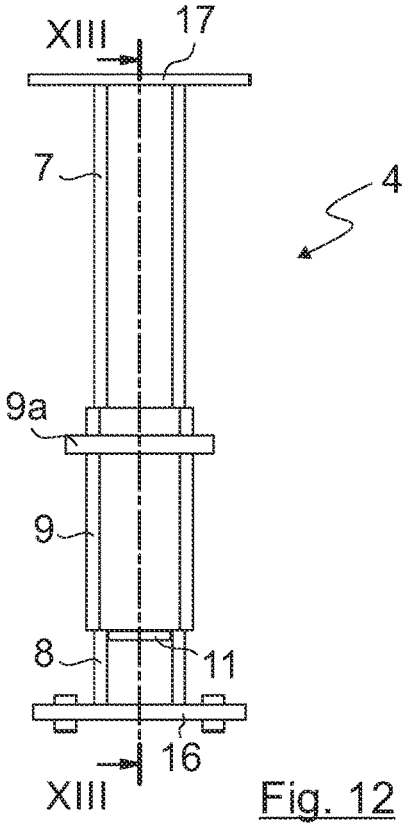
FIG. 12A side view of the support means according to FIG. 6.
Figure 13:
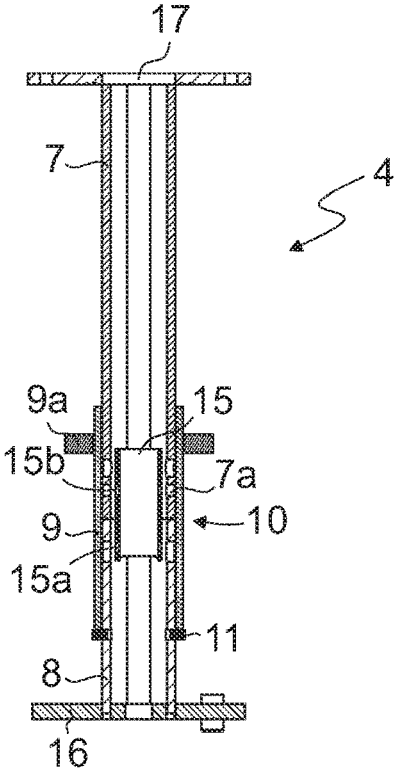
FIG. 13A sectional view along the XIII-XIII line of FIG. 12.
Figure 14:
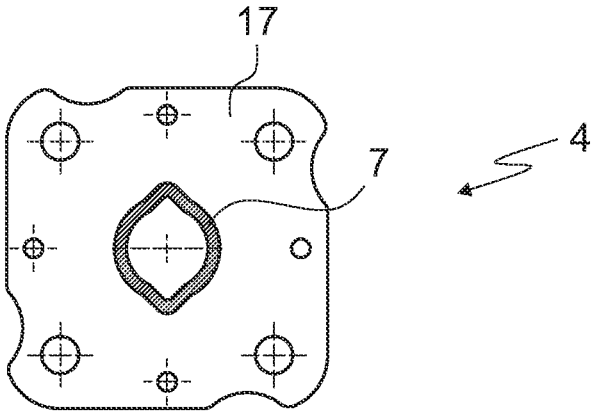
FIG. 14A section along the XIV-XIV line of FIG. 9.

A connecting element 15 is fixed to the other support tube, in the exemplary embodiment the upper support tube 7. The connecting element 15 is shown in an individual representation in FIG. 20. In the exemplary embodiment, the connecting element 15 is fixed to an inner wall of the support tube 7. This is shown in particular in FIGS. 10, 11, 13, and 16, with FIGS. 10, 11, and 13 showing a design of the connecting element 15 that differs from that of FIG. 20.

Figure 20:
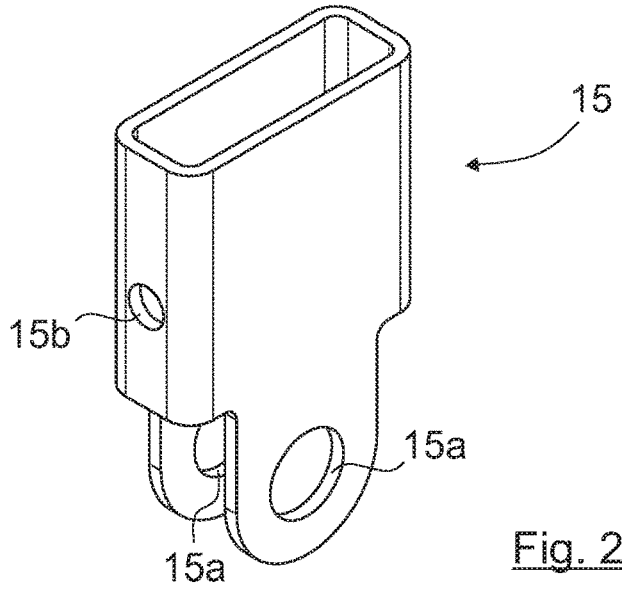
FIG. 20A perspective view of a connecting element.

To fix the connecting element 15 on the inner wall of the upper support tube 7, it can preferably be provided that the outer contour of the connecting element 15 is adapted to the radius of the inner wall of the support tube 7, for which purpose it can be sufficient, as shown in FIG. 20, if the longitudinal edges of the connecting element 15 are beveled or provided with a radius.

As shown in the exemplary embodiments, the connecting element 15 has one or more holes, in the exemplary embodiment exactly two holes 15*a*, through which the axis of rotation 13 fixed to the lower support tube 8 is guided in such a way that the connecting element 15 can be rotated about the axis of rotation 13.

As an alternative to the axis of rotation 13 and the elongated holes 14, a slotted guide can also be provided for carrying out the rotation movement.

In the exemplary embodiment, it is also provided that the connecting element 15 has holes 15*b*, by means of which the connecting element 15 can be fastened to the upper support tube 7.

In the exemplary embodiment, it is provided that the upper support tube 7 has holes 7*a* for attachment to the connecting element 15.

FIG. 6 to FIG. 14 and FIG. 22 to FIG. 23 show an embodiment of the support means 4 in which the outer circumference of the support tubes 7, 8 and the inner circumference of the support sleeve 9 have a noncircular cross section, in the exemplary embodiment a lemon-shaped cross section. Other cross-sectional shapes are possible as well, for example a polygonal cross section, a rectangular cross section, a square cross section, or a triangular cross section. Due to the fact that the support tubes 7, 8 and the support sleeve 9 have a cross section that is not circular and preferably lemon-shaped, torsional forces that can result from a twisting between the support tubes 7, 8 can be absorbed, whereby the stability of the support tubes 7, 8 is improved in particular in the working position and in particular makes it possible to avoid those forces, in particular the aforementioned torsional forces, that act on the axis of rotation 13 which can lead to damage there.

The exemplary embodiment according to FIGS. 15 to 19 and according to FIG. 21 shows a view in which the outer circumference of the support tubes 7, 8 and the inner circumference of the support sleeve 9 have a circular cross section. Such a design is particularly inexpensive.

It should be pointed out that, with the exception of these differences, all of the features illustrated in the exemplary embodiment can be realized in both exemplary embodiments without said realization requiring a separate mention.

In the exemplary embodiment, it is provided that the outer diameter of the support tubes 7, 8 with a circular cross section is 40 to 80 mm, preferably 40 to 70 mm, in particular 40 to 60 mm, preferably 50 mm+/−2 mm. If the cross section is not circular, in particular if the cross section is lemon-shaped, the length of a long axis of the cross section of the support tube 7, 8 can be 40 to 80 mm, preferably 40 to 70 mm, in particular 40 to 60 mm, preferably 51 mm+/−2 mm, and the length of a short axis of the cross section can be 5 to 25 mm, preferably 17 mm±2 mm shorter.

In both exemplary embodiments, it is advantageous if the wall thickness of the support tubes is at least 2.5 mm, preferably at least 3 mm, in particular at least 3.5 mm. Furthermore, it can be provided that the wall thickness is preferably less than 6 mm, in particular less than 5 mm, preferably less than 4.6 mm. Wall thicknesses between 3.5 mm and 4.5 mm, in particular 4.5 mm, are particularly advantageous. These values have proven to be particularly suitable for ensuring that, despite the bevel 12 in the working position, the weight of the ceiling to be poured can be reliably absorbed.

In both embodiments, it is advantageous if the support tubes 7, 8 together have a length of 200 to 600 mm, preferably 300 to 500 mm, more preferably 300 to 400 mm, very particularly preferably 340 to 360 mm, in particular 348.5 mm+/−2 mm. Furthermore, it has proven to be advantageous if the upper support tube 7 has a length that is greater than the length of the lower support tube 8. The length of the upper support tube 7 is preferably at least 1.5 times, preferably at least 1.8 times, the length of the lower support tube 8. It is also advantageous if the length of the upper support tube 7 is less than 4 times, preferably less than 3 times, the length of the lower support tube 8. It is advantageous if the length of the upper support tube 7 is 2 to 3 times, in particular 2 to 2.5 times, particularly preferably exactly 2 times, the length of the lower support tube 8.

In the exemplary embodiment, it is provided that the spindle device 5 is designed as part of the ceiling support 3. In principle, however, the spindle device 5 can also be part of the support means 4.

In the exemplary embodiment, the support means 4 is designed as an adapter or as an attachment for the detachable connection to an upper end of the ceiling support 3. For this purpose, a lower end region of the lower support tube 8 is designed with a lower adapter element 16 for a detachable attachment to the ceiling support 3. Alternatively, not shown in the exemplary embodiment, the ceiling support 3, an extension of the ceiling support 3, or a spindle portion, in particular a head spindle or the spindle device 5, can be formed on a lower end region of the lower support tube 8.

In the exemplary embodiment, it is also provided that an upper end region of the upper support tube 7 has an upper adapter element 17 for the detachable fixing of the support head 6 for the ceiling formwork panel 2. Alternatively, the support head 6 for the ceiling formwork panel 2 can be formed in one piece with the upper support tube 7 on the upper end region of the upper support tube 7 (not shown in the exemplary embodiment).

FIGS. 1 to 5 show the principle of a method for removing the ceiling formwork panels 2. For this purpose, it is provided that the ceiling support 3 is first lowered by means of the spindle device 5 until a support head 6 fixed to the support means 4 according to the invention, with which the ceiling support 3 is in engagement with the ceiling formwork panel 2, is disengaged or can be disengaged from the ceiling formwork panel 2. The support head 6 is then rotated by means of the support means 4 by a tilting angle α in such a way that the support tubes 7, 8 are rotated into the tilted position.

The support head 6 is rotated in such a way that the support head 6 is not in a rotation path of the ceiling formwork panel 2 when the support head 6 is rotated downwards about an axis of rotation that runs along a side edge of the ceiling formwork panel 2 that is not adjacent to the ceiling support 3. The result is shown in FIG. 5.

It should be pointed out that in order to carry out the method according to the invention, the spindle device 5 according to the invention with the two support tubes 7, 8 must not necessarily be used, but is preferred. A lowering can also be achieved with other support means that make it possible for the support head 6 to be lowered.

A particularly advantageous rotation of the support means 4 is shown below with reference to FIG. 1 to FIG. 5.

As shown, the ceiling formwork panels 2 preferably have a rectangular base region, which is usually formed by a formwork panel.

FIG. 1 to FIG. 5 show how the right front ceiling formwork panel 2 shown in FIG. 1 can be removed. The ceiling formwork panel 2 is rotated about one of the long side edges, in the exemplary embodiment about the left long side edge, which represents the axis of rotation of the ceiling formwork panel 2 in the context of the method.

Figure 3:
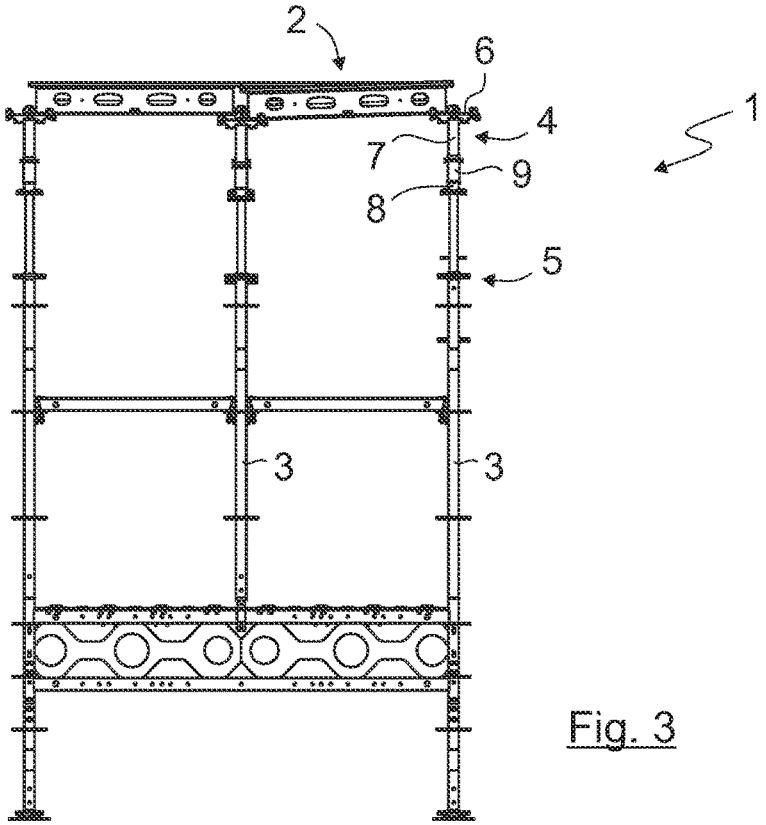
FIG. 3A side view of the ceiling formwork system according to FIG. 1, wherein the middle front ceiling support, which bears the left side of the ceiling formwork panel to be removed, is lowered in order to show the positioning of the right front ceiling formwork panel.

In order to remove the ceiling formwork panels 2, as shown in FIG. 3, the two ceiling supports 3, which support the long left side edge of the ceiling formwork panels 2, are first lowered, preferably by approx. 20 to 30 mm, in particular 25 mm.

Then the two ceiling supports 3, which support the right long side edge of the ceiling formwork panel 2, are lowered, and preferably, the two ceiling supports 3 are lowered by 30 to 70 mm, preferably by 50 mm.

The right side of the ceiling formwork panel 2 is then raised and supported again by means of a positioning aid 18 or a raising aid. This situation, in which the right side of the ceiling formwork panel 2 is raised by means of the positioning aid 18, is shown in FIG. 4.

The positioning aid 18 is usually a telescoping rod with a head that is suitable for engaging the underside of the ceiling formwork panels 2.

By lowering the ceiling support 3 by preferably 50 mm and then raising the ceiling formwork panel 2 again using the positioning aid 18, as can be seen from FIG. 4, the support head 6 is disengaged from the ceiling formwork panel 2 or the support head 6 is exposed. This is shown accordingly in FIG. 4.

In the exemplary embodiment, the ceiling supports 3 are lowered by means of the spindle device 5. The spindle device 5 can preferably have a head spindle.

The support head 6 is then rotated by means of the support means 4 by a tilting angle α in such a way that the support head 6 is no longer in a rotation path of the ceiling formwork panel 2. This is shown in FIG. 5. The rotation path of the ceiling formwork panel 2 results from the fact that the ceiling formwork panel 2 is rotated downwards about an axis of rotation, in the exemplary embodiment the left long side edge of the ceiling formwork panel 2.

FIG. 5 shows a situation in which the ceiling formwork panel 2 has already been rotated downwards. The ceiling formwork panel 2 can then be unhooked and transported away in a known manner.

Before the head 6 is rotated by a tilting angle α, the support head will preferably be lowered by 25 mm to 500 mm, in particular 50 mm to 400 mm. It has proven particularly suitable if it is lowered by 25 mm to 100 mm, preferably 35 mm to 70 mm, particularly preferably 40 mm to 55 mm. This also makes it possible for the support head 6 to be released and then rotated.

The order of mounting the ceiling formwork panel 2 and its positioning can be reversed. It is thus possible to carry out both the positioning and the removal process from a safe position from below.

In order to make it possible for the support head 6 to be rotated, it is provided in the exemplary embodiment that the support means 4 is designed in such a way as was described above with reference to the support means 4 according to the invention. The support means 4 can be operated in a particularly simple manner by manually pushing the support sleeve 9 upwards in order to unlock the support tubes 7, 8 that are in the working position and then, preferably also manually, rotate the upper support tube 7 into the tilted position.

The method according to the invention, as described with reference to FIG. 1 to FIG. 5, can also be carried out with a support means that has a different rotation mechanism.

The invention claimed is:

1. A support structure for a ceiling support for supporting a ceiling formwork panel, comprising:

at least one upper elongated support element; and a lower elongated support element, and the support elements are rotationally connected to one another, the support elements configured to be brought into a working position in which the support elements are preferably aligned coaxially with one another, and the support elements are rotatable into a tilted position in which the support elements are rotated by a tilting angle with respect to one another, with a locking element configured to prevent the support elements from rotating in the working position, the locking element bridging a connecting region between the two support elements in the working position, and the locking element configured to be brought into a release position, in which the locking element is arranged outside of the connecting region, wherein the locking element extends in the working position from a lower end region of the upper support element to an upper end region of the lower support element and thereby bridges the connecting region.

2. The support structure according to claim 1, wherein the locking element in the working position rests at least in portions on an inner wall and/or an outer wall of the support elements, with the locking element forming a guide with the support elements in order to move the locking element between the working position and the release position in a guided manner.

3. The support structure according to claim 1, wherein the lower support element is a lower support tube and/or the upper support element is an upper support tube and/or the locking element is a movable support sleeve.

4. The support structure according to claim 3, wherein the support sleeve is coaxially movable to the upper support tube and/or the lower support tube in order to bring the support sleeve into the release position.

5. The support structure according to claim 3, wherein the support tubes are rotatably connected to one another via an axis of rotation.

6. The support structure according to claim 5, wherein one of the support tubes has holes in order to fix the axis of rotation.

7. The support structure according to claim 5, wherein a connecting element is fixed on one of the support tubes, and the connecting element has one or more holes through which the axis of rotation fixed on the other support tube is guided in such a way that the connecting element is rotatable about the axis of rotation.

8. The support structure according to claim 7, wherein an outer contour of the connecting element is adapted at least in portions to an inner contour of the upper support element.

9. The support structure according to claim 7, wherein the connecting element has at least two surfaces running parallel and at a distance from one another, in each of which one of the holes is placed in such a way that the holes guide the axis of rotation in a defined manner.

10. The support structure according to claim 3, wherein an outer circumference of the lower support tube and/or an outer circumference of the upper support tube and an inner circumference of the support sleeve have a noncircular cross section comprising one of: a lemon-shaped cross section, a rectangular cross section, a triangular cross section, a triangular lemon-shaped cross section, a star-shaped cross section, or a polygonal cross section.

11. The support structure according to claim 10, wherein an outer diameter of the upper support tube and/or the lower support tube with a circular cross section is 40 to 80 mm, or that, with a noncircular cross section, the length of a long axis of the cross section of the upper support tube and/or the lower support tube is 40 to 80 mm, and that the length of a short axis of the cross section is 5 to 25 mm, shorter.

12. The support structure according to claim 11, wherein the outer diameter of the upper support tube and/or the lower support tube with a circular cross section is at least one of: 40 to 70 mm, 40 to 60 mm, or 50 mm+/−2 mm, or wherein, with a noncircular cross section, the length of a long axis of the cross section of the upper support tube and/or the lower support tube is at least one of: 40 to 70 mm, 40 to 60 mm, or 51 mm+/−2 mm, and the length of a short axis of the cross section is 17 mm+/−2 mm shorter.

13. The support structure according to claim 1, wherein the tilting angle between the upper support element and the lower support element in the tilted position is 5 to 90 degrees.

14. The support structure according to claim 1, wherein an upper front end of the lower support element has a bevel, the bevel being configured such that 40% to 90% of the upper front end of the lower support element is not provided with a bevel.

15. The support structure according to claim 1, wherein a spindle device is configured to change an overall length of the support structure and the ceiling support.

16. The support structure according to claim 1, wherein the ceiling support is a scaffolding pole or that part of the ceiling support is formed by a scaffolding pole.

17. The support structure according to claim 1, wherein an upper end region of the upper support element has an upper adapter element for releasably fixing a support head for the ceiling formwork panel or that a support head for the ceiling formwork panel is formed on an upper end region of the upper support element.

18. The support structure according to claim 1, wherein a lower end region of the lower support element has a lower adapter element to be detachably attached to the ceiling support or that the ceiling support, an extension of the ceiling support, or a spindle device is formed on a lower end region of the lower support element.

19. A ceiling support with the support structure according to claim 1.

20. The ceiling support according to claim 19, wherein the support structure is detachably fixed to an upper end of the ceiling support or designed in one piece with the ceiling support.

21. A ceiling formwork system, comprising:

at least one ceiling formwork panel, at least one ceiling support, and at least one support structure for the ceiling support, comprising:

at least one upper elongated support element; and a lower elongated support element, and the support elements are rotationally connected to one another, the support elements configured to be brought into a working position in which the support elements are preferably aligned coaxially with one another, and the support elements are rotatable into a tilted position in which the support elements are rotated by a tilting angle with respect to one another, with a locking element configured to prevent the support elements from rotating in the working position, the locking element bridging a connecting region between the two support elements in the working position, and the locking element configured to be brought into a release position, in which the locking element is arranged outside of the connecting region.

22. A method for removing a ceiling formwork panel which is supported by at least one ceiling support, comprising:

the ceiling support is first lowered via a spindle device until a support head with which the ceiling support is connected via a rotatable support means, can be disengaged from the ceiling formwork panel, whereupon the support head is then rotated by means of the support means by a tilting angle in such a way that the support head is not in a rotation path of the ceiling formwork panel when it can be rotated downwards about an axis of rotation that runs along a side edge of the ceiling formwork panel that is not adjacent to the ceiling support.

23. The method according to claim 22, wherein in order to rotate the support head, a locking element, which bridges a connecting region between an upper support element and a lower support element, from a working position in which the locking element prevents the support elements, is brought into a release position in which the locking element is arranged outside of the connecting region.

24. The method according to claim 23, wherein the upper support element is rotated about an axis of rotation that is fixed to the lower support element in order to bring the upper support element into the tilted position.

25. The method according to claim 22, wherein the support structure comprises:

at least one upper elongated support element; and a lower elongated support element, and the support elements are rotationally connected to one another, the support elements configured to be brought into a working position in which the support elements are preferably aligned coaxially with one another, and the support elements are rotatable into a tilted position in which the support elements are rotated by a tilting angle with respect to one another, with a locking element configured to prevent the support elements from rotating in the working position, the locking element bridging a connecting region between the two support elements in the working position, and the locking element configured to be brought into a release position, in which the locking element is arranged outside of the connecting region.

* * * * *